US008497232B2

(12) United States Patent
Shrestha et al.

(10) Patent No.: US 8,497,232 B2
(45) Date of Patent: Jul. 30, 2013

(54) FRICTION MODIFIER AND TRANSMISSION OIL

(75) Inventors: Kedar Shanker Shrestha, Kakegawa (JP); Michio Shiga, Hiratsuka (JP); Masami Fuchi, Makinohara (JP); Takahiro Nakagawa, Yoshida-Cyo (JP)

(73) Assignee: Chevron Japan Limited, San Ramon, CA (US)

( * ) Notice: Subject to any disclaimer, the term of this patent is extended or adjusted under 35 U.S.C. 154(b) by 37 days.

(21) Appl. No.: 12/846,708

(22) Filed: Jul. 29, 2010

(65) Prior Publication Data

US 2011/0028364 A1 Feb. 3, 2011

(30) Foreign Application Priority Data

Jul. 31, 2009 (JP) ..... 2009-179006

(51) Int. Cl.
*C10M 133/16* (2006.01)
*C10M 149/06* (2006.01)
*C07D 207/00* (2006.01)

(52) U.S. Cl.
USPC ..... 508/291; 508/188; 508/228; 508/242; 548/546

(58) Field of Classification Search
USPC ..... 508/291; 548/546
See application file for complete search history.

(56) References Cited

U.S. PATENT DOCUMENTS

| | | | | |
|---|---|---|---|---|
| 3,957,664 | A * | 5/1976 | Heilman et al. | 508/110 |
| 4,658,078 | A | 4/1987 | Slaugh et al. | |
| 5,312,555 | A | 5/1994 | Malfer | |
| 5,750,476 | A | 5/1998 | Nibert et al. | |
| 5,942,472 | A | 8/1999 | Watts et al. | |
| 6,703,356 | B1 * | 3/2004 | Wu | 508/591 |
| 2004/0102338 | A1 | 5/2004 | Harrison et al. | |
| 2004/0192562 | A1 * | 9/2004 | Morita | 508/185 |
| 2009/0181872 | A1 | 7/2009 | Yamada | |
| 2010/0062954 | A1 | 3/2010 | Fujita | |
| 2010/0137173 | A1 | 6/2010 | Sheets et al. | |

FOREIGN PATENT DOCUMENTS

| | | |
|---|---|---|
| EP | 1849757 | 10/2007 |
| EP | 1852408 | 11/2007 |
| EP | 1880986 | 1/2008 |

OTHER PUBLICATIONS

European Search Report, Nov. 8, 2010.

* cited by examiner

*Primary Examiner* — Ellen McAvoy
*Assistant Examiner* — Vishal Vasisth
(74) *Attorney, Agent, or Firm* — Carlton Virassammy; Claude J. Caroli

(57) ABSTRACT

A bis-type alkenyl-substituted succinimide which is prepared by reaction of succinic anhydride substituted with 2-alkenyl group having a branch structure in β-position with alkylene-polyamine and its derivatives derived from the bis-type alkenyl-substituted succinimide by post-treatment are of value as friction modifiers, particularly for incorporation into lubricating oils for automatic transmissions.

16 Claims, No Drawings

FRICTION MODIFIER AND TRANSMISSION OIL

FIELD OF INVENTION

The present invention relates to a novel friction modifier and to a lubricating oil, composition that contains the friction modifier; said composition demonstrates a high friction coefficient and good anti-shudder performance. Specifically, the lubricating oil composition comprises a β-positioned friction modifier and is particularly suited for automatic transmissions.

BACKGROUND OF INVENTION

Heretofore, an automatic transmission oil, that is, a lubricating oil for an automatic transmission, has been employed for assisting smooth operation of automatic transmission equipped with a torque converter, gear mechanism, wet clutch and hydraulic system, examples of such are automatic transmissions, continuously variable transmissions and dual clutch transmissions. In more recently developed automobiles, an increased focus is to increase performance and maintain improvements in fuel economy. In this regard, continuous research and improvement have been made in overall design and weight, component design and maximizing benefits from improved lubrication: particularly with respect to reduced friction and wear. Therefore, the recently developed automobiles have been manufactured to have a less volume and a less weight. The automatic transmissions are also required to be smaller sized, typically with smaller oil sumps, which operate under more severe conditions with higher torque capacity resulting in gear bearings receiving increased load or operating under higher speed rotations (6-speed AT). Even with more severe operating requirements, the lubricating oil is expected to maintain frictional characteristics with respect to the transmission clutches and minimize losses through the torque converter, thus improving of fuel economy. These, smaller sized and lighter weight automatic transmissions require a lubricating oil showing improved friction performance such as higher friction coefficient. In addition, since automobiles equipped with an automatic transmission sometimes encounter vibration (that is named "shudder") when the automatic transmission operates, the lubricating oil is required to decrease the shudder caused in the operation of the automatic transmission for a sufficiently long period of time. In addition, continuously variable transmissions (CVT) commonly transmit engine torques by steel pulleys and a steel V-belt or chain, thus lubricants for these apparatus require a high metal friction coefficient.

WO 97/14773 A1 discloses a lubricating fluid for power transmissions which contains an additive comprising an alkenyl-substituted succinimide that is prepared by reaction of a succinic anhydride substituted with an alkenyl group having a branch structure in β-position and polyamine. It is described that the addition of the additive enables to maintain good anti-shudder performance for a long period of time.

WO 97/14772 A1 discloses a lubricating oil composition containing an alkenyl-substituted succinimide that is prepared by reaction of a succinic anhydride substituted with an alkenyl group having a branch structure in α-position and an amine compound.

WO 2008/157467 A2 discloses novel pyrrolidine compounds and succinimide compound which are of value as friction modifiers for imparting excellent friction modifying performance to lubricating oil compositions without adverse effects on the viscosity properties of the lubricating oil composition at low temperatures.

Tribology Online, Japanese Society of Tribologists, 3, 6 (2008), pp. 328-332 discloses results of studies of low molecular weight alkenyl succinimides on anti-shudder performance. In the study, a number of low molecular weight alkenyl succinimides and aliphatic amide compounds are tested. Examples of the low molecular weight alkenyl succinimides include a bis-type alkenyl-substituted succinimide obtained by reaction of succinic anhydride which is substituted with 2-pentyl-2-tridecyl and an amine compound as well as a bis-type alkenyl-substituted succinimide obtained by reaction of succinic anhydride which is substituted with 2-hexyl-2-hexadecenyl and an amine compound.

SUMMARY OF INVENTION

As aspect of the present invention to provide a novel friction modifier imparting excellent friction modifying performances to lubricating oils and a lubricating oil composition containing the friction modifier. Particularly, to provide a lubricating oil composition favorably employable as a lubricating oil for automatic transmissions.

One aspect resides in a friction modifier comprising an alkenyl-substituted succinimide of the following formula (I) or a post-treated derivative thereof:

(I)

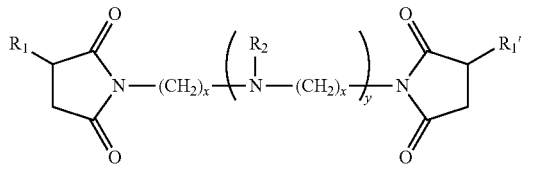

in which each of $R_1$ and $R_1'$ independently is an alkenyl group having a branch structure in β-position which is represented by the following formula (I), $R_2$ is a hydrogen atom, an alkyl group having 1 to 12 carbon atoms, an aryl group having 6 to 12 carbon atoms, an aralkyl group having 7 to 13 carbon atoms, or a 5-8 membered heterocyclic group, x is an integer of 1 to 6, and y is an integer of 0 to 20:

(1)

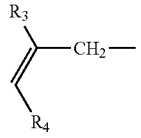

in which each of $R_3$ and $R_4$ is an aliphatic hydrocarbyl group and a total carbon atom number of $R_3$ and $R_4$ is in the range of 3 to 45, under the condition that a carbon atom number of $R_3$ is larger than a carbon atom number of $R_4$ by 3 or a carbon atom number of $R_3$ is smaller than a carbon atom number of $R_4$ by 1.

In another aspect, the invention resides in a friction modifier comprising an alkenyl-substituted succinimide of the following formula (II) or a post-treated derivative thereof:

(II)

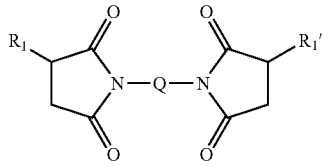

in which each of $R_1$ and $R_1'$ independently is an alkenyl group having a branch structure in β-position which is derived from a dimer of a single linear α-olefin having 3 to 24 carbon atoms, and Q is a residue of an alkylene-polyamine having 1 to 20 carbon atoms and containing an amino group at least at each terminal thereof.

The friction modifier provided by the invention is effective to impart improved friction performance as evidenced by an increased friction coefficient and a prolonged friction coefficient stability to a lubricating oil composition. Therefore, a lubricating oil composition containing the friction modifier of the invention can keep an automatic transmission from shuddering for a relatively long period of time.

Accordingly, in a further aspect, the invention resides in a lubricating oil composition containing a base oil of lubricating viscosity and the following additives:

0.1 to 10 wt. % of the friction modifier;

0.05 to 10 wt. % of a nitrogen-containing ashless dispersant;

0.1 to 10 wt. % of a phosphorus compound; and 0.005 to 4 wt. % of a metal-containing detergent.

Preferred aspects of the friction modifier of the invention are described below.

(1) Each of $R_3$ and $R_4$ in the formula (I) is a linear alkyl group and a total carbon atom number of $R_3$ and $R_4$ is in the range of 13 to 21.

(2) In the formula (I), x is 2 and y is an integer of 1 to 3.

(3) In the formula (I), x is 2 and y is 1.

(4) The post-treated derivative is the alkenyl-substituted succinimide of formula (I) which is post-treated with boric acid, phosphoric acid, a carboxylic acid or ethylene carbonate.

(5) The dimer utilized for preparing the alkenyl-substituted succinimide of the formula (II) or its post-treated derivative is prepared by dimerization of a single linear β-olefin having 8 to 12 carbon atoms.

(6) The dimer utilized for preparing the alkenyl-substituted succinimide of the formula (II) or its post-treated derivative is 2-hexyl-1-decene, 2-octyl-1-dodecene or 2-decyl-1-tetradecene, specifically 2-octyl-1-dodecene.

(7) The alkylene-polyamine utilized for preparing the alkenyl-substituted succinimide of the formula (II) or its post-treated derivative is ethylenediamine, diethylenetriamine or triethylenetetramine, specifically diethylenetriamine.

(8) The post-treated derivative is the alkenyl-substituted succinimide of formula (II) which is post-treated with boric acid, phosphoric acid, a carboxylic acid or ethylene carbonate.

(9) The friction modifier is added to a lubricating oil for an automatic transmission mounted to an automobile.

(10) The lubricating oil composition is for automatic transmissions.

(11) The lubricating oil composition is for automatic transmissions such as automatic transmissions, continuously variable transmissions and dual clutch transmissions.

(12) The lubricating oil composition contains the friction modifier in an amount of 0.5 to 5 wt. % (preferably 1 to 4 wt. %, more preferably 1.5 to 3 wt. %) per the amount of the lubricating oil composition.

(13) The lubricating oil composition further contains a nitrogen-containing ashless dispersant contained in the lubricating oil composition is polyisobutenyl succinimide or its post-treated compound.

(14) The post-treated compound is a borated polyisobutenyl succinimide.

(15) The lubricating oil composition further contains a phosphorus compound contained in the lubricating oil composition is phosphoric acid, a phosphoric acid ester, phosphorous acid, a phosphorous acid ester, thiophosphoric acid, or a thiophosphoric acid ester.

(16) The lubricating oil composition further contains an antioxidation agent.

(17) The lubricating oil composition further contains a corrosion inhibitor.

(18) The lubricating oil composition further contains a viscosity index improver.

(19) The base oil of the lubricating oil composition contains a saturated component in an amount of at least 90 wt. %, a viscosity index of 120 or more, and a sulfur content of 0.03 wt. % or less.

The friction modifier of the invention as well as a base oil and various additives comprised in the lubricating oil composition are described in more detail.

Friction Modifier

The friction modifier of the invention is an alkenyl-substituted succinimide represented by the aforementioned formula (I) or (II) or its post-treated compound.

The alkenyl-substituted succinimide of the formula (I) can be prepared by reacting succinic anhydride substituted with a 2-alkenyl group having a branched structure in the β-position of formula (2) with a polyamine.

The succinic anhydride substituted with a 2-alkenyl group having a branched structure in the β-position can be prepared by the reaction between succinic anhydride with an alkene compound having a particular vinylidene group. The alkene compound having a vinylidene group can be represented by the following formula (2):

(2)

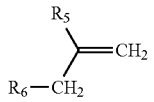

In the formula (2), each of $R_5$ and $R_6$ is an aliphatic hydrocarbyl group (preferably a linear or branched alkyl group, more preferably a linear alkyl group) under such condition that a carbon atom number of $R_5$ is larger than a carbon atom number of $R_6$ by 3 or a carbon atom number of $R_5$ is smaller than a carbon atom number of $R_6$ by 1.

Examples of the alkene compound having a vinylidene group include 2-hexyl-1-decene, 2-octyl-1-dodecene and 2-decyl-1-tetradecene. Each of these alkene compounds can be prepared by dimerizing 1-octene, 1-decene and 1-dodecene, respectively. Particularly suited alpha olefins for dimerizing are 1-hexene, 1-octene, 1-decene, 1 dodecene, 1-tetradecene, 1-hexadecene, 1-octadecene, 1 eicosane, or mixtures of these materials. Typically these olefins are produced through the oligimerization of a C2 to C20 alpha-olefin in the presence of a metallocene catalyst.

The above-mentioned alkene compounds having a vinyldene group and their preparing methods are described in EP 1 880 986A1 (WA 2006-225348) and EP 1852408 A 1 (JPA 2006-232672) incorporated herein by reference.

The preferred polyalkylene amines used to prepare the succinimides are of the formula 3:

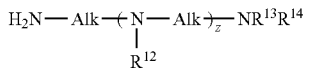

wherein z is an integer of from 0 to 10, preferably 0 to 3; Alk is an alkylene radical of 2 to 10 carbons, preferably 2 to 6 carbon atoms; $R^{12}$, $R^{13}$, and $R^{14}$ are each independently selected from is a hydrogen atom, an alkyl group having 1 to 12 carbon atoms, an aryl group having 6 to 12 carbon atoms, an aralkyl group having 7 to 13 carbon atoms, or a 5-8 membered heterocyclic group.

The alkylene amines include principally methylene amines, ethylene amines, butylene amines, propylene amines, pentylene amines, hexylene amines, heptylene amines, octylene amines, other polymethylene amines and also the cyclic and the higher homologs of such amines as piperazine and amino alkyl-substituted piperazines. They are exemplified specifically by ethylene diamine, triethylene tetraamine, propylene diamine, decamethyl diamine, octamethylene diamine, diheptamethylene triamine, tripropylene tetraamine, tetraethylene pentamine, trimethylene diamine, pentaethylene hexamine, ditrimethylene triamine, 2-heptyl-3-(2-aminopropyl)-imidazoline, 4-methyl imidazoline, N,N-dimethyl-1,3-propane diamine, 1,3-bis(2-aminoethyl)imidazoline, 1-(2-aminopropyl)-piperazine, 1,4-bis(2-aminoethyl)piperazine and 2-methyl-1-(2-aminobutyl)piperazine. Higher homologs such as are obtained by condensing two or more of the above-illustrated alkylene amines likewise are useful.

The ethylene amines are especially useful. They are described in some detail under the heading "Ethylene Amines" in Encyclopedia of Chemical Technology, Kirk-Othmer, Vol. 5, pp. 898-905 (Interscience Publishers, New York, 1950). The term "ethylene amine" is used in a generic sense to denote a class of polyamines conforming for the most part to the structure 4:

$$H_2N(CH_2CH_2NH)_aH$$

wherein a is an integer from 1 to 10.

Thus, it includes, for example, ethylene diamine, diethylene triamine, triethylene tetraamine, tetraethylene pentamine, pentaethylene hexamine, and the like. Examples of particularly suitable polyamine employable for the preparation of the alkenyl-substituted alkenylsuccinimide of the invention include ethylenediamine, diethylenetriamine and triethylenetetramine. Most preferred is diethylenetriamine.

The individual alkenyl succinimides used in the alkenyl succinimide composition of the present invention can be prepared by conventional processes, such as disclosed in U.S. Pat. Nos. 2,992,708; 3,018,250; 3,018,291; 3,024,237; 3,100,673; 3,172,892; 3,202,678; 3,219,666; 3,272,746; 3,361,673; 3,381,022; 3,912,764; 4,234,435; 4,612,132; 4,747,965; 5,112,507; 5,241,003; 5,266,186; 5,286,799; 5,319,030; 5,334,321; 5,356,552; 5,716,912, the disclosures of which are all hereby incorporated by reference in their entirety for all purposes.

The reaction between the succinic anhydride substituted with a 2-alkenyl group having a branched structure in the β-position and polyamine can be performed in the manner similar to the known manner for the reaction between succinic anhydride and polyamine.

The friction modifier of the invention can be an alkenyl-substituted succinimide represented by the aforementioned formula (I) or (II) per se. Otherwise, the friction modifier can be a post-treated alkenyl-substituted succinimide which is obtained by post-treatment of the alkenyl-substituted succinimide with a known post-treating agent such as boric acid, phosphoric acid, a carboxylic acid or ethylene carbonate.

It should be noted that the reaction between the succinic anhydride substituted with a 2-alkenyl group having a branched structure in the β-position and a polyamine may give a relatively small amount of a mono-type alkenyl-substituted succinimide of the following formula (III) in addition to the bis-type alkenyl-substituted succinimide of the formula (I) or (II):

(III)

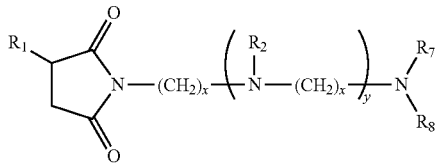

In the formula (III), each of $R_1$, $R_2$, x and y has the aforementioned meaning, and each of $R_7$ and $R_8$ independently represents a hydrogen atom, an alkyl group having 1-12 carbon atoms, an aryl group having 6-12 carbon atoms, an aralkyl group having 7-13 carbon atoms, or a 5-8 membered heterocyclic group.

Therefore, the friction modifier of the invention may contain a small amount (20 wt. % or less) of the monotype alkenyl-substituted succinimide of the formula (III) in addition to the bis-type alkenyl-substituted succinimide of the formula (I) or (II).

Base Oil

There are no specific limitations with respect to the base oil to be employed for the preparation of the lubricating oil composition of the invention. For instance, base oils having various physical properties, for instance, base oils which are known for the conventional transmission oils or conventional engine oils for engines (particularly gasoline engines) of automobiles. Examples of the base oil include mineral oils belonging to Groups I to III, synthetic oils belonging to Group IV, and other oils belonging to Group V, which are described in API 1509. Preferred are mineral oils and synthetic oils containing a saturated component in an amount of at least 85 wt. % (more preferably, at least 90 wt %), a viscosity index of 100 or more (more preferably 120 or more), and a sulfur content of 0.03 wt. % or less (more preferably 0.001 wt. % or less).

The mineral-type base oil is preferably obtained by treating a distillate having a lubricating viscosity with known methods such as solvent refining and hydrogenation. Preferred are hydrocracked oils which typically have a viscosity index of 120 or more, an evaporation loss (according to ASTM D5800) of 15 wt. % or less, a sulfur content of 0.001 wt. % or less, and an aromatic content of 10 wt. % or less). A mixture of oils containing 10 wt. % or more of the hydrocracked oil is also employable. The hydrocracked oil can be an oil having a high viscosity index (e.g., a viscosity index of 140 or more, specifically a viscosity index in the range of 140 to 150) which is produced by isomerization or hydrocracking of a mineral type slack wax or a synthetic wax prepared from natural gas, namely, gas-to-liquid (GTL) wax. The hydrocracked oil is preferably employable as a base oil of the lubrication oil composition of the invention due to its low sulfur content, low evaporating property and low carbonaceous residue.

The synthetic oil (synthetic lubricating base oil) can be poly-α-olefins produced by polymerization of α-olefin having 3 to 12 carbon atoms, dialkyl diesters prepared by esterification of di-basic acids (e.g., sebacic acid, azelaic acid, and adipic acid) with an alcohol having 4-18 carbon atoms, such as dioctyl sebacate, polyol esters prepared by esterification of mono-basic acids having 3 to 18 carbon atoms with 1-trimethylolpropane or pentaerythritol, or alkylbenzenes having an alkyl group of 9-14 carbon atoms. The synthetic oil is preferred as a base oil of the lubricating oil composition of the invention because not only it generally contains no sulfur-containing components but also it shows good oxidation resistance and good thermal resistance. Most preferred is poly-α-olefin.

The mineral base oil and synthetic base oil can be used singly or in combination such as combinations of two or more mineral base oils, combinations of two or more synthetic base oils, and combinations of mineral base oils and synthetic base oils in optional ratios.

Nitrogen-containing Ashless Dispersant

Representative examples of the nitrogen-containing ashless dispersants employable for the preparation of the lubricating oil composition of the invention include alkenyl- or alkyl-succinimide of which alkenyl group or alkyl group is derived from polyolefin and its derivatives. A representative alkenyl- or alkyl-succinimide can be obtained by the reaction of succinic anhydride substituted with an alkenyl or alkyl group having a high molecular weight with a polyalkylene polyamine having 3-10 (preferably 4-7) nitrogen atoms per mole. The alkenyl or alkyl group having a high molecular weight preferably is polyolefin having an average molecular weight of approx. 900 to 5,000. Most preferred is polybutene.

In the process for preparing polybutenylsuccinic anhydride by the reaction of polybutene and maleic anhydride, the chlorination method employing chlorine can be employed. However, although the chlorination method gives the succinimide in a good yield, it generally results in the production of the succinimide containing a relatively large chlorine content (e.g., approx. 2,000 ppm). In contrast, the thermal method employing no chlorine can yields the succinimide containing an extremely small chlorine content (e.g., approx. 40 ppm or less). In addition, if a highly reactive polybutene (containing a methylvinylidene structure of approx. 50% or more) is employed in the thermal method in place of the conventional polybutene (mainly having β-olefinic structure), the reactivity of the thermal method increases. The increase of the reactivity is advantageous results in reduction of unreacted polybutene in the produced dispersant which favorably has an active component (succinimide) of an high concentration. Therefore, it is preferred that the polybutenylsuccinic anhydride is obtained by employing the high reactive polybutene in the thermal method, and that the resulting polybutenyl succinic anhydride is reacted with a polyalkylene polyamine having an average nitrogen atoms of 3 to 10 (per one molecule) to give a succinimide. The succinimide can be further reacted (or treated) with borate, an alcohol, an aldehyde, a ketone, an alkylphenol, a cyclic carbonate, or an organic acid to give a modified succinimide. Particularly, borated alkenyl (or alkyl)succinimide is preferred because of its high thermal and oxidation resistance.

The succinimide can be of a mono-type, a bis-type or a poly-type, which corresponds to number of the imide structure in one molecule. In the lubricating oil composition of the invention, succinimides of bis-type and poly-type are preferably employed.

The nitrogen-containing ashless dispersant can be a polymer-containing succinimide which is prepared using an ethylene-β-olefin copolymer having a molecular weight in the range of 1,000 to 15,000, and an ashless dispersant of alkenylbenzylamine type.

Metal-containing Detergent

There are no specific limitations with respect to the metal-containing detergent employable for the lubricating oil composition of the invention. It is preferred, however, to employ a sulfonate. Examples of the sulfonate include a salt of an alkali metal (e.g, Li, Na) or an alkaline earth metal (e.g., Mg, Ca) of a sulfonic acid such as a petroleum sulfonic acid, an alkylbenzenesulfonic acid or an alkyltoluenesulfonic acid which has a TBN (total base number) in the range of 10 to 500 mg KOH/g, or its over-based product. The metal-containing detergent can be employed singly or in combination.

Further, an alkylsalicylate, an alkylcarboxylate or a phenate of an alkali metal or an alkaline earth metal can be employed alone or in combination with the above-mentioned sulfonate.

Phosphorus Compound

The phosphorus compounds can be those which are known as anti-wear agents employable in the lubricating oil compositions. Examples of the phosphorus compound include phosphoric acid, a phosphoric acid ester, phosphorous acid, a phosphorous acid ester, thiophosphoric acid and a thiophosphoric acid ester. Also employable are amine salts of the phosphoric acid ester and phosphorous acid ester.

Examples of the phosphate esters include triaryl phosphates, trialkyl phosphates, trialkylaryl phosphalkyl phosphates, triarylalkyl phosphates, and trialkenyl phosphates. Specific examples include triphenyl phosphate, tricresyl phosphate, benzyl diphenyl phosphate, ethyl diphenyl phosphate, tributyl phosphate, ethyl dibutyl phosphate, cresyl diphenyl phosphate, dicresyl phenyl phosphate, ethylphenyl diphenyl phosphate, di(ethylphenyl)phenyl phosphate, propylphenyl diphenyl phosphate, di(propylphenyl)phenyl phosphate, triethylphenyl phosphate, tripropylphenyl phosphate, butylphenyl diphenyl phosphate, di(butylphenyl)phenyl phosphate, tributylphenyl phosphate, trihexyl phosphate, tri(2-ethylhexyl)phosphate, tridecyl phosphate, trilauryl phosphate, trimyristyl phosphate, tripalmityl phosphate, tristearyl phosphate, and trioleyl phosphate.

Examples of the acid phosphate esters include 2-ethylhexyl acid phosphate, ethyl acid phosphate, butyl acid phosphate, oleyl acid phosphate, tetracosyl acid phosphate, isodecyl acid phosphate, lauryl acid phosphate, tridecyl acid phosphate, stearyl acid phosphate, and isostearyl acid phosphate.

Examples of the phosphite esters include triethyl phosphite, tributyl phosphite, triphenyl phosphite, tricresyl phosphite, tri(nonylphenyl)phosphite, tri(2-ethylhexyl)phosphite, tridecyl phosphite, trilauryl phosphite, triisooctyl phosphite, diphenyl isodecyl phosphite, tristearyl phosphite, and trioleyl phosphite.

Examples of the acid phosphite esters include dibutyl hydrogen phosphite, dilauryl hydrogen phosphite, dioleyl hydrogen phosphite, distearyl hydrogen phosphite, and diphenyl hydrogen phosphite. Among these phosphoric acid esters, tricresyl phosphate and triphenyl phosphate are preferred.

Examples of the amines which form amine salts with the phosphoric acid esters include monosubstituted amines, disubstituted amines, and trisubstituted amines. Examples of the monosubstituted amines include butylamine, pentylamine, hexylamine, cyclohexylamine, octylamine, laurylamine, stearylamine, oleylamine, and benzylamine. Examples of the disubstituted amines include dibutylamine, dipentylamine, dihexylamine, dicyclohexylamine, dioctylamine, dilaurylamine, distearylamine, dioleylamine, dibenzylamine, stearylmonoethanolamine, decylmonoethanolamine, hexylmonopropanolamine, benzylmonoethanolamine, phenylmonoethanolamine, and tolylmonopropanolamine. Examples of the trisubstituted amines include tributylamine, tripentyl amine, trihexylamine, tricyclohexylamine, trioctylamine, trilaurylamine, tristearylamine, trioleylamine, tribenzylamine, dioleylmonoethanolamine, dilaurylmonopropanolamine, dioctylmonoethanolamine, dihexylmonopropanolamine, dibutylmonopropanolamine, oleyldiethanolamine, stearyldipropanolamine, lauryldiethanolamine, octyldipropanolamine, butyldiethanolamine, benzyldiethanolamine, phenyldiethanolamine, tolyldipronanolamine, xylyldiethanolamine, triethanolamine, and tripropanolamine.

Examples of thiophosphoric acid esters include alkyl trithiophosphites, aryl or alkylaryl thiophosphates, and zinc dialkyl dithiophosphates. Of these, lauryl trithiophosphite, triphenyl thiophosphate, and zinc dilauryl dithiophosphate are particularly preferred.

These extreme-pressure agents may be used singly or in combination of two or more species and are generally used in an amount of 0.01 to 10 mass %, based on the total amount of a transmission fluid composition, preferably 0.05 to 5 mass, from the viewpoint of, for example, balance between the effect and the cost Oxidation Inhibitor The lubricating oil composition of the invention can contain an oxidation inhibitor. The oxidation inhibitor preferably is a known inhibitor such as a phenolic oxidation inhibitor or an amine oxidation inhibitor. The oxidation inhibitor may be contained in the lubricating oil composition in an amount of 0.1 to 5 wt. %, preferably 0.5 to 3 wt. %.

The phenolic oxidation inhibitor can be a hindered phenol compound. The amine oxidation inhibitor can be a diarylamine compound.

Examples of the hindered phenol oxidation inhibitor include 2,6-di-t-butyl-p-cresol, 4,4'-methylenebis(2,6-di-t-butylphenol), 4,4'-methylenebis(6-t-butyl-o-cresol), 4,4'-isopropylidenebis(2,6-di-t-butylphenol), 4,4'-bis(2,6-di-t-butylphenol), 2,2'-methylenebis(4-methyl-6-t-butylphenol), 4,4'-thiobis(2-methyl-6-t-butylphenol), diethylenebis[3-(3,5-di-t-butyl-4-hydroxyphenyl)propionate], octyl 3-(3,5-di-t-butyl-4-hydroxyphenyl)propionate, octadecyl 3-(3,5-di-t-butyl-4-hydroxyphenyl)propionate and octyl 3-(5-t-butyl-4-hydroxy-3-methylphenyl)propionate.

Examples of the diarylamine oxidation inhibitor include a mixed alkyldiphenylamine having 4 to 9 carbon atoms, p,p'-dioctyldiphenylamine, phenyl-α-naphthylamine, phenyl-β-naphthylamine, alkylated α-naphthylamine and alkylated phenyl-α-naphthylamine.

The hindered phenol oxidation inhibitor and diarylamine oxidation inhibitor can be employed singly or in combination. If desired, other oil-soluble oxidation inhibitors can be employed in combination.

The lubricating oil composition of the invention can further contain other additives. Examples of other additives include a viscosity index improver (e.g., dispersant type viscosity improver or non-dispersant type viscosity improver which include polymethacrylate polymers, ethylene-propylene copolymers, styrene-isoprene copolymers, hydrated styrene-isoprene copolymers, and polyisobutylene are all used as viscosity index improvers. Particularly preferred viscosity index improvers are the polymethacrylate polymers. Nitrogen- and oxygen-functionalized polymers, the so-called dispersant viscosity index improvers, may also be used.), a corrosion inhibitor (e.g., a copper corrosion inhibitor such as thiazol compound, triazole compound, thiadiazole compound), a seal-swelling agent (e.g., an oil-soluble dialkylester of a dibasic acid such as adipic acid, azelaic acid, sebacic acid, or phthalic acid), a dye (e.g., red dye), a defoaming agent, and a pour-point depressant (e.g., polymethacrylic acid ester, polyacrylic acid ester, polyacrylamide).

EXAMPLES

Synthesis Example 1

Synthesis of Friction Modifier According to the Invention

Bis-type β-branched Primary 2-alkenyl Succinimide

2-Octyl-1-dodecene (1 mol), maleic anhydride (1 mol) and 2,2-thiodiethylbis[3-(3,5-di-tert-butyl-4-hydroxyphenyl) propionate] (oxidation inhibitor, 0.003 mol) were mixed, and the mixture was reacted at 200° C. for 4 hours, to give a primary alkenyl succinic anhydride. To the alkenyl succinic anhydride (1 mol) was added diethylene triamine (0.5 mol). The mixture was reacted at 160° C. for 2 hours and subsequently dried under reduced pressure for 30 minutes to yield a reaction product. By LR spectroscopy, it was confirmed that the reaction product was the desired bis-type β-branched primary 2-alkenyl succinimide (product comprising two alkenyl succinimide moieties bridged with a diethylenetriamine residue, nitrogen content: 4.9 wt. %).

Synthesis Example 2

Synthesis of Friction Modifier According to the Invention

Bis-type β-branched Primary 2-alkenyl Succinimide

The procedures of Synthesis Example 1 were repeated except for replacing diethylenetriamine with triethylenetetramine, to yield the desired bis-type β-branched primary 2-alkenylsuccinimide (reaction product comprising two alkenylsuccinimide moieties bridged with a triethylenetetramine residue).

Synthesis Comparative Example 3

Synthesis of Friction Modifier for Comparison

Bis-type α-branched Secondary 2-alkenyl Succinimide

To isooctadecenyl succinic anhydride (prepared by the reaction of maleic anhydride with octadecene produced by isomerization (internal olefination) of linear 1-octadecene, 1 mol) was added diethylenetriamine (0.5 mol). The resulting mixture was reacted at 160° C. for 2 hours, and subsequently dried under reduced pressure for 30 minutes, to give a reaction product. By IR spectroscopy, it was confirmed that the reaction product was the desired bis-type α-branched secondary 2-alkenyl succinimide (nitrogen content: 5.2 wt %).

Examples, Reference Examples and Comparison Oils

—Preparation of Lubricating Oil Composition—

The lubricating oil composition was prepared by adding the below-described nitrogen-containing ashless dispersant, friction modifier, metal-containing detergent, oxidation inhibitor, corrosion inhibitor, phosphorus compound, viscosity index improver, pour point depressant, seal-swelling agent and defoaming agent in the below-described amounts to the below-described base oil in the below-described amount.

(1) Base oil (79.50 wt. %)

Paraffinic hyper purified mineral oil (2) Nitrogen-containing ashless dispersant (3.80 wt. %)

Borated polyisobutenyl succinimide (3) Friction modifier 1 (2.50 wt. %)

Examples 1 and 2 (Friction modifier prepared in the aforementioned Synthesis Example 1)

Examples 3 and 4 (Friction modifier prepared in the aforementioned Synthesis Example 2)

Reference Example (Friction modifier prepared in the aforementioned Synthesis Example 3)

(4) Friction modifier 2 (0.20 wt. %)

A mixture of a conventional amine-type friction modifier and a conventional ester-type friction modifier (5) Metal-containing detergent (0.60 wt. %)

A mixture of overbased sulfonate and overbased salicylate (6) Oxidation inhibitor (1.20 wt. %)

A mixture of an amine-type oxidation inhibitor and a phenol-type oxidation inhibitor (7) Corrosion inhibitor (0.07 wt. %)

A mixture of a thiadiazole-type corrosion inhibitor and a benzotriazole-type corrosion inhibitor (8) Phosphorus compound (0.30 wt. %)

Alkyl Phosphite (9) Viscosity index improver (11.00 wt. %)

A dispersant-type polymethacrylate viscosity index improver

(10) Pour-point depressant (0.20 wt. %)

A polymethacrylate-type pour-point depressant

(11) Seal-swelling agent (0.60 wt. %)

A sulforane-type seal-swelling agent

(12) Defoaming agent

A silicon-type defoaming agent

—Lubricating Oil Composition for Comparison—

Two commercially available transmission oils (CVTF, Comparison Oil A and Comparison Oil B) were purchased for comparison.

—Evaluation Method for Lubricating Oil Composition—

(1) Determination of Friction Coefficient

The friction coefficient was determined in terms of a metal-metal friction coefficient by means of a block-on-ring tester according to "Standard test method for metal on metal friction characteristics of belt CVT fluids" described in JASO M358:2005. Details of the testing method are described below.

Testing conditions

Ring: Falex S-10 Test Ring (SAE 4620 Steel)

Block: Falex H-60 Test Block (SAE 01 Steel)

Amount of oil 150 mL

Break-in Conditions

Oil temperature: 110° C.

Load: 5 min. under 890 N and 25 min. under 1112 N

Sliding velocity: 5 min. at 0.5 m/s-25 min. at 1.0 m/s

Testing Conditions

Oil temperature: 110° C.

Load: 1112 N

Sliding velocity: 5 min. each at 1.0, 0.5, 0.25, 0.125, 0.075, 0.025 m/s

Friction coefficient: a friction coefficient for 30 sec. before the change of the sliding velocity (2) Determination of Anti-Shudder Performance Durability The anti-shudder performance durability was determined by means of a low velocity friction apparatus according to "Road vehicles—Test method for anti-shudder performance of automatic transmission fluids" described in JASO M-349: 2001. Details of the testing method are described below.

Testing conditions

Friction material: cellulose disc/steel plate

Amount of oil: 150 mL

Break-in conditions

Contact pressure: 1 MPa

Oil temperature: 80° C.

Sliding velocity: 0.6 m/s

Sliding time: 30 minutes

μ-V Performance test conditions

Contact pressure: 1 MPa

Oil temperature: 40, 80, 120° C.

Sliding velocity: continuously increasing and decreasing between 0 m/s to 1.5 m/s Durability test conditions Contact pressure: 1 MPa Oil temperature: 120° C.

Sliding velocity: 0.9 m/s

Time: 30 minutes

Rest time: 1 minute

Performance measurement time: μ-V characteristics was measured every 24 hour from 0 hour Note: The anti-shudder performance was evaluated by determining a period of time until dμ/dV at 0.9 m/s reached 0. The longer the determined period of time is, the better the anti-shudder performance is.

—Results of Evaluation of Lubricating Oil Composition—

The friction coefficient and anti-shudder durability were determined for each lubricating oil and are set forth in Tables 1 and 2.

TABLE 1

| | Example 1 | Example 2 | Example 3 | Example 4 |
|---|---|---|---|---|
| | Friction modifier | | | |
| | Syn. Ex. 1 | | Syn. Ex. 2 | |
| Friction coefficient | 2.5 wt. % | 1.5 wt. % | 2.5 wt. % | 1.5 wt. % |
| 1 m/s | 0.084 | 0.097 | 0.096 | 0.103 |
| 0.5 m/s | 0.114 | 0.114 | 0.116 | 0.117 |
| 0.25 m/s | 0.128 | 0.129 | 0.127 | 0.129 |
| 0.125 m/s | 0.137 | 0.135 | 0.134 | 0.134 |
| 0.075 m/s | 0.140 | 0.139 | 0.137 | 0.138 |
| 0.025 m/s | 0.144 | 0.141 | 0.140 | 0.141 |
| Average friction coefficient | 0.125 | 0.126 | 0.125 | 0.127 |
| Anti-shudder durability (hours) | 504 | 288 | 288 | 264 |

TABLE 2

| | Ref. Example | Com. Oil A | Com. Oil B |
|---|---|---|---|
| | Friction modifier | | |
| | Syn. Ex. 3 | Unknown | |
| Friction coefficient | 2.5 wt. % | Unknown | |
| 1 m/s | 0.072 | 0.077 | 0.085 |
| 0.5 m/s | 0.098 | 0.102 | 0.105 |
| 0.25 m/s | 0.117 | 0.123 | 0.118 |
| 0.125 m/s | 0.129 | 0.133 | 0.125 |
| 0.075 m/s | 0.134 | 0.137 | 0.128 |

TABLE 2-continued

| | Ref. Example | Com. Oil A | Com. Oil B |
|---|---|---|---|
| | | Friction | |
| | Syn. Ex. 3 | Unknown modifier | |
| Friction coefficient | 2.5 wt. % | Unknown | |
| 0.025 m/s | 0.139 | 0.141 | 0.138 |
| Average friction coefficient | 0.115 | 0.119 | 0.117 |
| Anti-shudder durability (hours) | 456 | 192 | 96 |

—Evaluation—

As is apparent from the friction coefficient at each sliding velocity, each of the lubricating oil compositions of Examples 1 to 4 containing the friction modifier according to the invention gives a high friction coefficient at each sliding velocity which less varies in the range of 1 m/s to 0.025 m/s, and gives a high average friction coefficient. Moreover, the lubricating oil compositions of Examples 1 to 4 show sufficiently long anti-shudder duration.

In contrast, the commercially available CVTF (Com. Oil A) gives a relatively low friction coefficient and shows a relatively short anti-shudder duration. The commercially available CVTF (Com. Oil B) also gives a relatively low friction coefficient and shows a further shorter anti-shudder duration.

The lubricating oil composition of Comparison Example which contained the friction modifier prepared in Synthesis Example 3 shows a long anti-shudder duration but gives a relatively low friction coefficient.

Accordingly, it is apparent that the lubricating oil composition containing a friction modifier of the invention shows excellent performances, particularly, as transmission oil.

What is claimed is:

1. A friction modifier comprising an alkenyl-substituted succinimide of the following formula (I) or a post-treated derivative thereof:

(I)

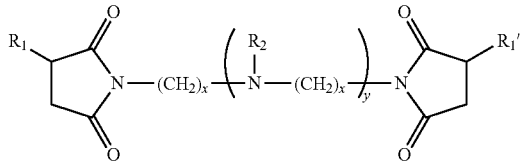

in which each of $R_1$ and $R_1'$ independently is an alkenyl group having a branch structure in β-position which is represented by the following formula (1), $R_2$ is a hydrogen atom, an alkyl group having 1 to 12 carbon atoms, an aryl group having 6 to 12 carbon atoms, an aralkyl group having 7 to 13 carbon atoms, or a 5-8 membered heterocyclic group, x is an integer of 1 to 6, and y is an integer of 0 to 20:

(1)

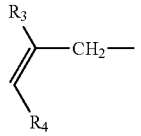

in which each of $R_3$ and $R_4$ is an aliphatic hydrocarbyl group and a total carbon atom number of $R_3$ and $R_4$ is in the range of 3 to 45, under the condition that a carbon atom number of $R_3$ is larger than a carbon atom number of $R_4$ by 3 or a carbon atom number of $R_3$ is smaller than a carbon atom number of $R_4$ by 1;

wherein each of $R_1$ and $R_1'$ independently is an alkenyl group having a branch structure in β-position which is derived from a dimer of a single linear α-olefin having 3 to 24 carbon atoms.

2. The friction modifier of claim 1, in which each of $R_3$ and $R_4$ is a linear alkyl group and the total carbon atom number of $R_3$ and $R_4$ is in the range of 13 to 21.

3. The friction modifier of claim 1, in which x is 2 and y is an integer of 1 to 20.

4. The friction modifier of claim 1, in which x is 2 and y is 1.

5. The friction modifier of claim 1, in which the post-treated derivative is an alkenyl-substituted succinimide of formula (I) which is post-treated with boric acid, phosphoric acid, a carboxylic acid or ethylene carbonate.

6. A lubricating oil composition containing a base oil of lubricating viscosity and the following additives:

0.1 to 10 wt. % of the friction modifier of claims 1;

0.05 to 10 wt. % of a nitrogen-containing ashless dispersant;

0.1 to 10 wt. % of a phosphorus compound; and 0.05 to 4 wt. % of a metal-containing detergent.

7. The lubricating oil composition of claim 6, which is an automatic transmission oil, a continuously variable transmission oil, or a dual clutch transmission oil.

8. A friction modifier comprising an alkenyl-substituted succinimide of the following formula (II) or a post-treated derivative thereof:

(II)

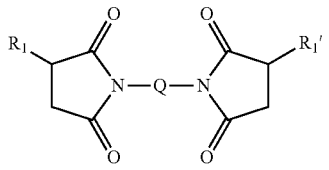

in which each of $R_1$ and $R_1'$ independently is an alkenyl group having a branch structure in β-position which is derived from a dimer of a single linear α-olefin having 3 to 24 carbon atoms, and Q is a residue of an alkylene-polyamine having 1 to 20 carbon atoms and containing an amino group at least at each terminal thereof.

9. The friction modifier of claim 8, in which the dimer is prepared by dimerization of a single linear α-olefin having 8 to 12 carbon atoms.

10. The friction modifier of claim 9, in which the dimer is 2-hexyl- 1-decene, 2-octyl-1-dodecene or 2-decyl-1-tetradecene.

11. The friction modifier of claim 9, in which the dimer is 2-octyl-1-dodecene.

12. The friction modifier of claim 8, in which the alkylene-polyamine is ethylenediamine, diethylenetriamine or triethylenetetramine.

13. The friction modifier of claim 12, in which the alkylene-polyamine is diethylenetriamine.

14. The friction modifier of claim 8, in which the post-treated derivative is the alkenyl-substituted succinimide of formula (II) which is post-treated with boric acid, phosphoric acid, a carboxylic acid or ethylene carbonate.

15. A lubricating oil composition containing a base oil of lubricating viscosity and the following additives:

0.1 to 10 wt. % of the friction modifier of claims 8;

0.05 to 10 wt. % of a nitrogen-containing ashless dispersant;

0.1 to 10 wt. % of a phosphorus compound; and 0.005 to 4 wt. % of a metal-containing detergent.

16. The lubricating oil composition of claim 15, which is an automatic transmission oil, a continuously variable transmission oil, or a dual clutch transmission oil.

* * * * *